US007204641B2

(12) United States Patent
Stolmeier

(10) Patent No.: US 7,204,641 B2
(45) Date of Patent: Apr. 17, 2007

(54) POUCH WITH SPOUT

(75) Inventor: Robert C. Stolmeier, Shelbyville, IN (US)

(73) Assignee: Illinois Tool Works Inc., Glenview, IL (US)

( * ) Notice: Subject to any disclaimer, the term of this patent is extended or adjusted under 35 U.S.C. 154(b) by 228 days.

(21) Appl. No.: 10/666,060

(22) Filed: Sep. 18, 2003

(65) Prior Publication Data

US 2004/0131284 A1 Jul. 8, 2004

Related U.S. Application Data

(60) Provisional application No. 60/411,908, filed on Sep. 19, 2002.

(51) Int. Cl.
*B65D 33/16* (2006.01)
*B65D 30/20* (2006.01)
*B65D 33/00* (2006.01)

(52) U.S. Cl. ..... 383/64; 383/61.2; 383/120; 383/210; 383/906

(58) Field of Classification Search ..... 383/63–64, 383/906, 120, 210–211, 61.2
See application file for complete search history.

(56) References Cited

U.S. PATENT DOCUMENTS 1,920,321 A 8/1933 Rosmait
1,930,659 A 10/1933 Purdy
1,951,599 A 3/1934 Dever
2,098,258 A 11/1937 Rowe
2,147,117 A 2/1939 Bensel
2,188,039 A 1/1940 Farmer
2,358,653 A * 9/1944 Mock ..... 383/64
2,696,342 A 12/1954 Toberg
2,929,123 A * 3/1960 Schneideman ..... 24/399
2,978,769 A 4/1961 Harrah
3,030,003 A 4/1962 Schanzle
3,137,419 A 6/1964 Davy
3,361,333 A 1/1968 Stuart
3,619,395 A 11/1971 Skendzic
3,685,562 A 8/1972 Ausnit
4,071,187 A 1/1978 LaFleur
4,191,230 A 3/1980 Ausnit
4,241,865 A 12/1980 Ferrell
4,301,639 A 11/1981 Hamilton
4,332,344 A 6/1982 Strodthoff
4,333,299 A 6/1982 Hamilton
4,337,889 A 7/1982 Moertel
4,358,466 A 11/1982 Stevenson
4,415,386 A 11/1983 Ferrell et al.
4,534,752 A 8/1985 Ferrell et al.
4,617,683 A 10/1986 Christoff
4,620,320 A 10/1986 Sullivan
4,620,665 A 11/1986 McSherry
4,637,063 A 1/1987 Sullivan et al.
4,655,862 A 4/1987 Christoff et al.
4,657,792 A 4/1987 Ausnit
4,691,370 A 9/1987 MacFee (Continued)

FOREIGN PATENT DOCUMENTS

DE 3144702 A1 5/1983

(Continued)

*Primary Examiner*—Jes F. Pascua
(74) *Attorney, Agent, or Firm*—John V. Daniluck; Bingham McHale LLP

(57) ABSTRACT

A reclosable container with a slider arranged to open and close interlockable profiles on the mouth of the container. The profiles are fixed together at one end but are separable at the other end to allow a gusset to fold outwardly to form a pour spout.

8 Claims, 10 Drawing Sheets

U.S. PATENT DOCUMENTS

| | | | | |
|---|---|---|---|---|
| 4,706,297 | A | 11/1987 | Ausnit | |
| 4,736,450 | A | 4/1988 | Van Erden et al. | |
| 4,758,099 | A | 7/1988 | Branson | |
| 4,786,190 | A | 11/1988 | Van Erden et al. | |
| 4,787,880 | A | 11/1988 | Ausnit | |
| 4,823,961 | A | 4/1989 | Griesbach et al. | |
| 4,840,611 | A | 6/1989 | Van Erden et al. | |
| 4,844,759 | A | 7/1989 | Boeckmann | |
| 4,878,987 | A | 11/1989 | Ven Erden | |
| 4,886,373 | A | 12/1989 | Corella | |
| 4,902,140 | A | 2/1990 | Branson | |
| 4,909,017 | A | 3/1990 | McMahon et al. | |
| 4,925,316 | A | 5/1990 | Van Erden et al. | |
| 4,953,708 | A | 9/1990 | Beer et al. | |
| 4,956,964 | A | 9/1990 | Jones et al. | |
| 4,971,454 | A | 11/1990 | Branson et al. | |
| 4,997,104 | A | 3/1991 | Pohl | |
| 4,997,289 | A | 3/1991 | Sasaki et al. | |
| 5,005,707 | A | 4/1991 | Hustad et al. | |
| 5,030,190 | A | 7/1991 | Woods et al. | |
| 5,035,517 | A | 7/1991 | Edelman | |
| 5,037,138 | A | 8/1991 | McClintock et al. | |
| 5,048,692 | A | 9/1991 | Handler et al. | |
| 5,059,033 | A | 10/1991 | Branson | |
| 5,104,235 | A | 4/1992 | Bronstrup et al. | |
| 5,107,658 | A | 4/1992 | Hustad et al. | |
| 5,161,350 | A | 11/1992 | Nakamura | |
| 5,172,980 | A | 12/1992 | Provost | |
| 5,181,365 | A | 1/1993 | Garvey et al. | |
| 5,186,707 | A | 2/1993 | Barta | |
| 5,240,112 | A | 8/1993 | Newburger | |
| 5,273,514 | A | 12/1993 | Kristensen | |
| 5,275,491 | A | 1/1994 | Kuge et al. | |
| 5,350,240 | A | 9/1994 | Billman et al. | |
| 5,364,189 | A | 11/1994 | Kuge | |
| 5,392,589 | A | 2/1995 | Buchanan | |
| 5,400,565 | A | 3/1995 | Terminella et al. | |
| 5,461,845 | A | 10/1995 | Yeager | |
| 5,468,206 | A | 11/1995 | Buchanan | |
| 5,480,230 | A | 1/1996 | May | |
| 5,547,284 | A | 8/1996 | Imer | |
| 5,692,837 | A | 12/1997 | Beer | |
| 5,699,653 | A | 12/1997 | Hartman et al. | |
| 5,716,473 | A | 2/1998 | Gordon et al. | |
| 5,768,852 | A | 6/1998 | Terminella et al. | |
| 5,772,332 | A | 6/1998 | Geller | |
| 5,782,562 | A | 7/1998 | Anspacher | |
| 5,782,733 | A | 7/1998 | Yeager | |
| 5,788,378 | A | 8/1998 | Thomas | |
| 5,806,984 | A | 9/1998 | Yeager | |
| 5,816,709 | A | 10/1998 | Demus | |
| 5,823,933 | A | 10/1998 | Yeager | |
| 5,829,884 | A | 11/1998 | Yeager | |
| 5,882,117 | A | 3/1999 | Laffon | |
| 5,911,508 | A | 6/1999 | Dobreski et al. | |
| 5,938,337 | A | 8/1999 | Provan et al. | |
| 5,938,339 | A | 8/1999 | Ouchi | |
| 5,941,643 | A | 8/1999 | Linkiewicz | |
| 5,951,453 | A | 9/1999 | Yeager | |
| 5,964,532 | A | 10/1999 | St. Phillips et al. | |
| 6,030,123 | A | 2/2000 | Mitarai | |
| 6,068,585 | A | 5/2000 | Ouchi | |
| 6,071,011 | A | 6/2000 | Thomas et al. | |
| 6,082,897 | A | 7/2000 | Galomb | |
| 6,116,314 | A | 9/2000 | Johnson | |
| 6,132,089 | A | 10/2000 | Galomb et al. | |
| 6,149,302 | A | 11/2000 | Taheri | |
| 6,164,826 | A | 12/2000 | Petkovsek | |
| 6,177,172 | B1 | 1/2001 | Yeager | |
| 6,178,722 | B1 | 1/2001 | McMahon | |
| 6,186,663 | B1 * | 2/2001 | Ausnit | 383/63 |
| 6,217,216 | B1 | 4/2001 | Taheri | |
| 6,224,528 | B1 | 5/2001 | Bell | |
| 6,244,021 | B1 | 6/2001 | Ausnit et al. | |
| 6,254,273 | B1 | 7/2001 | Galomb et al. | |
| 6,254,519 | B1 | 7/2001 | Toshima | |
| 6,261,000 | B1 | 7/2001 | Bois | |
| 6,279,298 | B1 | 8/2001 | Thomas et al. | |
| 6,286,189 | B1 | 9/2001 | Provan et al. | |
| 6,286,999 | B1 | 9/2001 | Cappel et al. | |
| 6,289,561 | B1 | 9/2001 | Provan et al. | |
| 6,290,393 | B1 | 9/2001 | Tomic | |
| 6,293,073 | B1 | 9/2001 | Caudle | |
| 6,296,388 | B1 | 10/2001 | Galomb et al. | |
| D451,794 | S | 12/2001 | Ichikawa | |
| 6,325,543 | B1 * | 12/2001 | Ausnit | 383/210.1 |
| 6,332,712 | B1 | 12/2001 | Headley | |
| 6,339,911 | B2 | 1/2002 | Bois | |
| 6,343,455 | B2 | 2/2002 | Bois | |
| 6,357,914 | B1 | 3/2002 | Kinigakis et al. | |
| 6,386,762 | B1 | 5/2002 | Randall et al. | |
| 6,389,780 | B1 | 5/2002 | Coomber et al. | |
| 6,390,676 | B1 | 5/2002 | Colombo et al. | |
| 6,393,804 | B1 | 5/2002 | Ausnit | |
| D458,121 | S | 6/2002 | Ichikawa | |
| 6,398,412 | B2 | 6/2002 | Wed | |
| 6,412,254 | B1 | 7/2002 | Tilman et al. | |
| 6,416,221 | B2 | 7/2002 | Price | |
| 6,461,043 | B1 | 10/2002 | Healy et al. | |
| 6,464,394 | B1 | 10/2002 | Galomb | |
| 6,474,045 | B2 | 11/2002 | McMahon et al. | |
| 6,499,878 | B1 | 12/2002 | Dobreski et al. | |
| 6,519,917 | B2 | 2/2003 | Forman | |
| 6,519,918 | B2 | 2/2003 | Forman et al. | |
| 6,523,325 | B1 | 2/2003 | Forman et al. | |
| D471,088 | S | 3/2003 | Kinigakis et al. | |
| 6,530,870 | B2 | 3/2003 | Buchman et al. | |
| 6,533,456 | B1 | 3/2003 | Buchman | |
| 6,533,711 | B1 | 3/2003 | Anderson et al. | |
| 6,543,640 | B2 | 4/2003 | Russo | |
| 6,572,267 | B1 | 6/2003 | Forman | |
| 6,575,625 | B2 | 6/2003 | Cappel et al. | |
| 6,609,353 | B1 | 8/2003 | McMahon et al. | |
| 6,616,333 | B2 | 9/2003 | Kinigakis et al. | |
| 6,745,545 | B2 | 6/2004 | Schneider et al. | |
| 6,783,276 | B2 | 8/2004 | Machacek et al. | |
| 6,805,485 | B2 * | 10/2004 | Hogan et al. | 383/64 |
| 6,817,160 | B2 | 11/2004 | Schmidt | |
| 6,820,391 | B2 | 11/2004 | Barmore et al. | |
| 6,821,238 | B2 | 11/2004 | Crevier et al. | |
| 6,834,474 | B2 | 12/2004 | Dutra et al. | |
| 6,840,675 | B2 | 1/2005 | Knight | |
| 6,857,779 | B2 | 2/2005 | Olin | |
| 6,863,646 | B2 | 3/2005 | Kinigakis et al. | |
| 6,874,935 | B2 | 4/2005 | Edelman et al. | |
| 6,893,673 | B2 | 5/2005 | Hander et al. | |
| 6,899,460 | B2 | 5/2005 | Turvey et al. | |
| 6,939,041 | B2 | 9/2005 | Kinigakis et al. | |
| 6,962,439 | B2 | 11/2005 | Taheri | |
| 6,971,794 | B2 | 12/2005 | Yeager | |
| 6,974,256 | B2 | 12/2005 | Kinigakis et al. | |
| 6,981,936 | B2 | 1/2006 | Plourde et al. | |
| 6,986,236 | B2 | 1/2006 | Schneider et al. | |
| 6,988,828 | B2 | 1/2006 | Linneweil | |
| 6,994,470 | B2 | 2/2006 | Galomb | |
| 7,011,448 | B2 | 3/2006 | Olin | |
| 2001/0000461 | A1 | 4/2001 | Pfeiffer et al. | |
| 2001/0002504 | A1 | 6/2001 | Provan et al. | |
| 2001/0017950 | A1 | 8/2001 | Strand et al. | |
| 2001/0038016 | A1 | 11/2001 | Russo | |
| 2002/0033396 | A1 | 3/2002 | Hupp et al. | |
| 2002/0072460 | A1 | 6/2002 | Ausnit | |

| | | | | |
|---|---|---|---|---|
| 2002/0152723 | A1 | 10/2002 | Ausnit | |
| 2002/0154837 | A1 | 10/2002 | Ausnit | |
| 2002/0194816 | A1 | 12/2002 | Schneider et al. | |
| 2003/0100424 | A1 | 5/2003 | Barmore et al. | |
| 2004/0146224 | A1* | 7/2004 | Piotrowski et al. | 383/64 |

FOREIGN PATENT DOCUMENTS

| | | | |
|---|---|---|---|
| DE | 20012652 | A1 | 1/2001 |
| EP | 0 834 454 | B1 | 2/2000 |

* cited by examiner

POUCH WITH SPOUT

This application claims the benefit of priority to U.S. provisional patent application Ser. No. 60/411,908, filed Sep. 19, 2002, which is incorporated herein by reference.

FIELD OF THE INVENTION

The present invention pertains to improved methods and apparatus for packaging, and, in particular, to improved containers which include a sliding element.

SUMMARY OF THE INVENTION

It is an object of the invention to provide a reclosable slider container that has improved means for pouring the contents of the container.

One embodiment of the invention might involve a flexible reclosable container having a flat bottom upon which the container can stand upright. The container has a side in which there is formed a foldable gusset and also has a mouth. There is a pair of interlockable fastener strips mounted on the mouth of the container with the strips being joined together at one end and separable at the other end. The gusset is unfoldable to an exterior position when the strips are separated to form a spout for pouring the contents from the interior of the container.

Another embodiment of the invention might involve a container comprising nonrigid sheet material formed to have a mouth, having first and second sides. The mouth also has first and second ends. A first fastener strip is attached to the sheet material at the first side of the mouth. The first strip has a first end and a second end with the first end of the first strip attached at the first end of the mouth. A second fastener strip is attached to the sheet material at the second side of the mouth. The second strip has a first end and a second end with a first end of the second strip attached to the first end of the mouth. The first strip and the second strip are capable of releasable connection to each other. A slider is received on the strips and is movable in a first direction toward the first end of the mouth to connect the first strip to the second strip and is movable in a second direction toward the second end of the mouth to disconnect the first strip from the second strip. The first end of the first strip is not attached to the first end of the second strip. The sheet of material forms a gusset at the first end of the mouth.

Still another embodiment of the invention involves a flexible, reclosable container having a pair of side walls forming a mouth having first and second sides. The mouth has first and second ends. A first interlockable profile is attached proximate a first side of the mouth with the first profile having a first end and a second end. The first end of the first profile is attached proximate the first end of the mouth. A second interlockable profile is attached proximate a second side of the mouth. The second profile has a first end and a second end with the first end of the second profile being attached proximate the first end of said mouth. The first profile and the second profile are adapted and configured to releasably interlock with each other. There is provided a slider, slidingly coupled to the first profile and the second profile such that sliding the slider in a first direction toward the first end of mouth interlocks said first profile to said second profile. And sliding said slider in a second direction toward the second end of the mouth unlocks the first profile from the second profile. The first end of the first profile is not attached to the first end of the second profile and one of the first end of the first profile or the first end of the second profile includes an end stop for limiting the movement of the slider in the first direction.

DESCRIPTION OF THE PREFERRED EMBODIMENT

Figure 1:
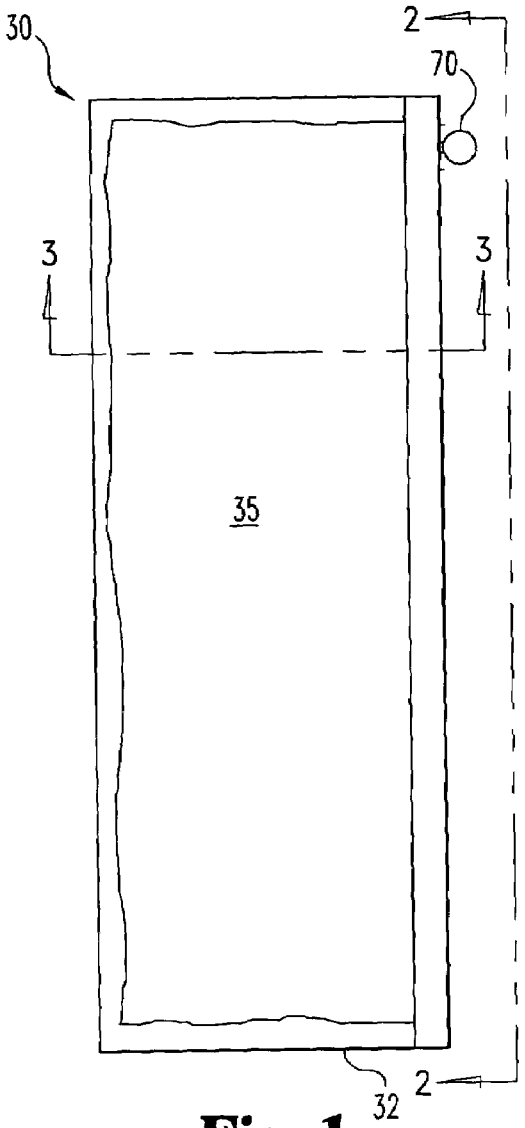
FIG. 1 is a side plan view of an apparatus according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

This application incorporates by reference the following U.S. patent application Ser. No. 08/965,722, filed Nov. 7, 1997, which issued as U.S. Pat. No. 5,956,924; Ser. No. 09/090,851, filed Jun. 4, 1998, which issued as U.S. Pat. No. 6,257,763; Ser. No. 09/493,718, filed Jan. 28, 2000, which issued as U.S. Pat. No. 6,216,423; Ser. No. 60/330,140, filed Oct. 17, 2001; Ser. No. 10/107,694, filed Mar. 27, 2002; Ser. No. 60/368,243, filed Mar. 28, 2002; Ser. No. 60/389,193, filed Jun. 17, 2002; and Ser. No. 10/228,236, filed Aug. 26, 2002.

The present invention pertains to improved methods and apparatus for containers. In one embodiment of the present invention, there is a container of semi-rigid paper or cardboard walls which includes within it a roll of flexible film, such as the type of film used by consumers to cover an object that has food on it. The flexible film held within this container is wrapped on a roll and must be cut to the desired length by the consumer. In one embodiment of the present invention, a tracked, slidable cutter is positioned along an open edge of the container. The flexible film can be drawn out of the container by the consumer and placed over a track along one edge of the container. The consumer then moves the slidable cutter along the track, cutting the flexible film to the desired length. In some embodiments of the present invention, the slidable cutter moves along a rigid track. In another embodiment of the present invention, the slidable cutter moves along a pair of flexible interengagable strips or members. In some embodiments, the strips are fastened to each other at each end of the path of the slidable cutter. In yet other embodiments, the strips are fastened to each other at only one end, and are not fastened to each other at any other position along the length of the cutter path.

According to another embodiment of the present invention, there is a preferably flexible container, such as a stand up pouch, preferably including one or more folding gussets along one of the sides. This container includes a mouth through which a consumer can remove contents of the container, or add something to the container. A pair of interlockable fastener profiles, which can be flexible, semi-rigid or rigid, extend along the mouth. A slider is coupled to the profiles, and can be slid along the length thereof for repeated unlocking and interlocking of the profiles. In one embodiment, the profiles are fused together at one end, and are not otherwise attached to each other along their length, except for the engagement that occurs as a result of the interlocking of the profiles. The unattached end of interlockable fastener strips is positioned at the end of the container which is intended to be the opened end of the container. When the slider is moved from this unattached end toward the fused end of the interlockable fastener strips, the extent to which the mouth of the container can be opened is not limited or constrained by the fastener strips, since the fastener strips are not attached to each other.

In one embodiment of the present invention, the unattached and uncoupled ends of the fastener profile are along a side of a container that includes a folding gusset which can be folded outward to form a pouring spout. The opened width of the spout is greater than the width that could be obtained if the fastener profiles were coupled to each other at the spout end. The present invention also contemplates those embodiments which do not include any side gussets, and which are not stand up pouches.

Figure 2:
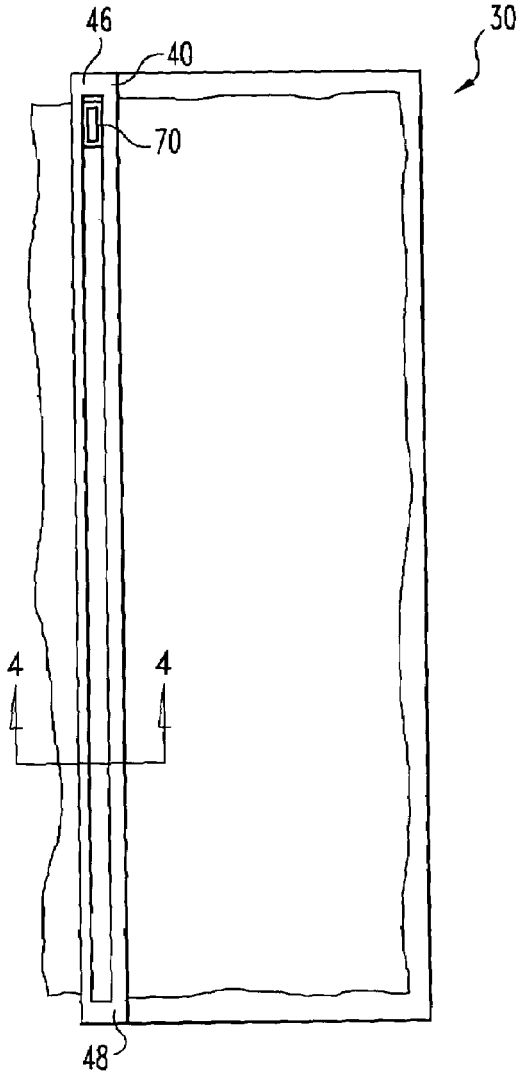
FIG. 2 is a top plan view of the apparatus of FIG. 1 as taken along lines 2—2 of FIG. 1.
Figure 3:
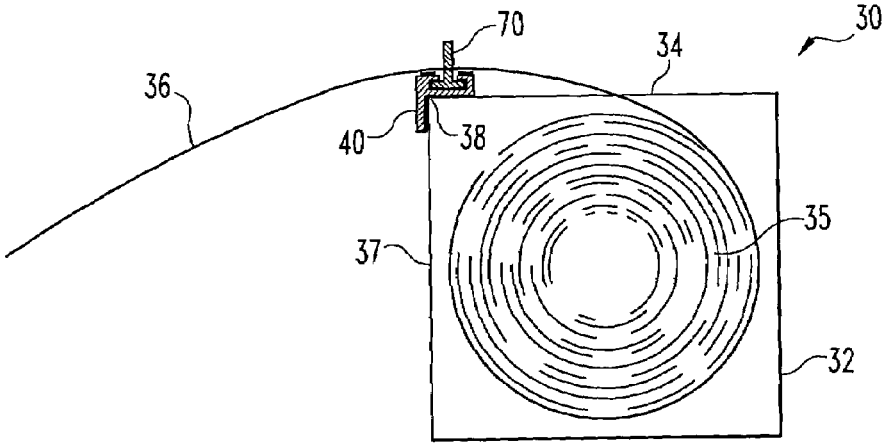
FIG. 3 is a cross sectional view of the apparatus of FIG. 1 as taken along lines 3—3 of FIG. 1.

Referring to FIGS. 1, 2, and 3, an apparatus 30 is shown according to one embodiment of the present invention. Apparatus 30 includes a container 32 having an opening 34. A supply 35 of flexible film is located within container 32. In one embodiment, container 32 is comprised of a plurality of semi-rigid cardboard walls 37, and the flexible film is a low density polyethylene film suitable for covering and storing food. However, the present invention is not so limited and contemplates container walls of any type, including both rigid and flexible types. Further, the contents of the container can be any type of sheet or film, including plastic, paper, and metal foil, as examples. Further, the supply can be on a roll, and can also be folded or otherwise stored within the container.

Figure 4:
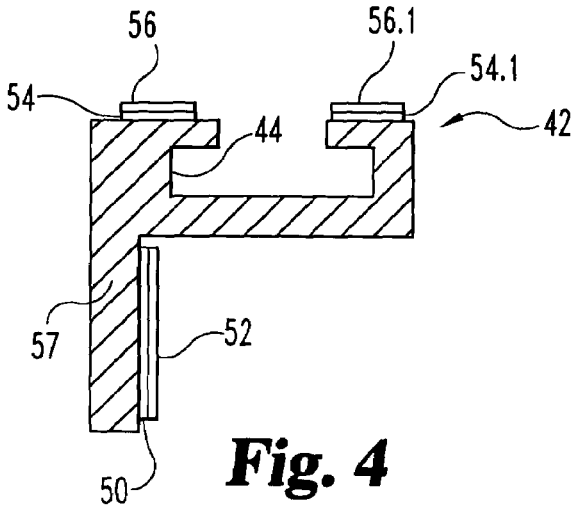
FIG. 4 is a cross sectional view of a portion of the apparatus of FIG. 2 as taken along line 4—4 of FIG. 2.

Container 32 includes an edge 38 along a wall 37. As best seen in FIG. 3, a cutting assembly 40 is mounted along the length of edge 38. Cutting assembly 40 includes a cutting guide 42 (as best seen in FIG. 4). Cutting guide 42 defines an internal track 44. Track 44 is closed at each end, having first and second track endstops 46 and 48.

As best seen in FIGS. 3 and 4, cutting assembly 40 is coupled proximate to edge 38 by a first adherent surface coating 50 which is applied to one surface of a lip 57. Cutting assembly 40 preferably includes a first removable cover 52 which is located along adherent surface coating 50 prior to attachment of track 44 to wall 37. In one embodiment of the present invention, cutting assembly 40 is stored within container 32 when apparatus 30 is first presented to a consumer for purchase, or before apparatus 30 is used for its supply 35 of film. In this embodiment, the user or consumer opens a new container 32, removes cutting assembly 40 from the interior of the container, and removes first cover 52 from first adherent surface coating 50. The consumer or user then locates cutting assembly 40 along the length of edge 38 proximate to container opening 34. Surface coating 50 maintains cutting assembly 40 in the adhered position along edge 38 (as best seen in FIG. 3) preferably until the supply 35 of flexible film is exhausted. Although what has been shown and described is a cutting assembly stored within the container prior to first use, the present invention also contemplates those embodiments in which one or more portions of the cutting assembly are attached to the container prior to usage of the container by the consumer.

Referring to FIG. 4, cutting assembly 40 preferably includes a second adherent surface coating 54 placed adjacent to the opening of track 44. Prior to usage of cutting assembly 40, a second removable cover 56 protects adherent surface coating 54. After cutting assembly 40 has been adhered along edge 38, the user removes cover 56 and exposes adherent surface coating 54. As the free edge 36 of the supply 35 of film is withdrawn from container 32, the film can be adhered to coating 54 by the user at a location that relates to the desired cut width of the film. In some embodiments, cutting guide 42 includes a second adhesive layer 54.1, such that adhesive layers 54 and 54.1 are located on either side of the opening of track 44. After removal of covers 56 and 56.1, the exposed adherent surfaces can be used to hold stationary the film to be cut.

Figure 5:
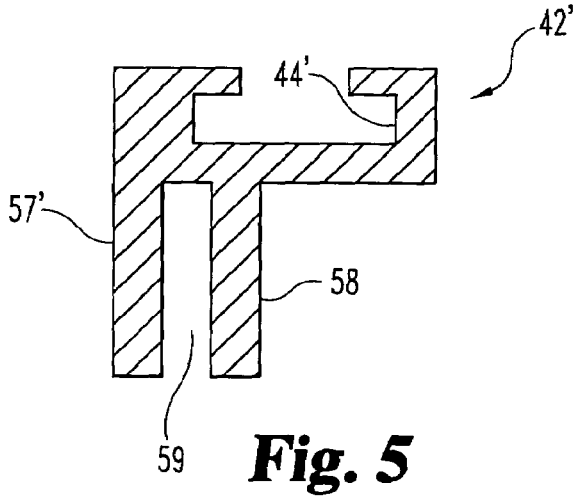
FIG. 5 is a cross sectional view of an alternate embodiment of the apparatus of FIG. 4.

FIG. 5 depicts an alternate cutting guide 42 according to another embodiment of the present invention. The use of a prime (') designation after an element number (XX') refers to a feature of the invention that is the same as the non-prime feature (XX) previously described except for those differences shown and described hereafter. Cutting guide 42' includes a second lip 58 spaced apart from first lip 57' so as to form a slot 59 therebetween. Slot 59 is adapted and configured to accept therein free edge 38 of container 32. In some embodiments, the surfaces forming slot 59 are smooth and uncoated, whereas in other embodiments, one or more surfaces of slot 59 include an adherent coating.

Figure 13:
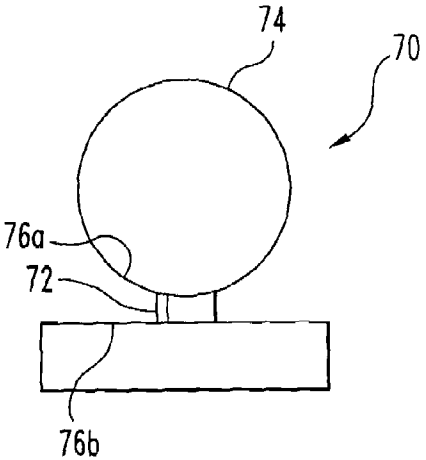
FIG. 13 is a side elevational view of the slidable cutter of FIG. 12 as taken along line 13—13 of FIG. 12 in the direction of the arrows.
Figure 12:
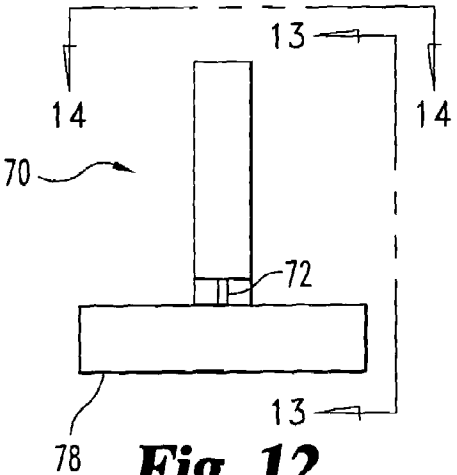
FIG. 12 is an end elevational view of the slidable cutter of FIG. 1.
Figure 14:
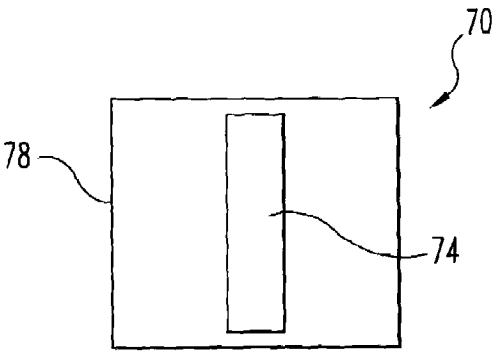
FIG. 14 is a top plan view of the slidable cutter of FIG. 12 as taken along line 14—14 of FIG. 12 in the direction of the arrows.

Cutting assembly 40 preferably includes a slidable cutter 70, as best seen in FIGS. 12, 13, and 14. Cutter 70 includes a cutting element 72 located at the narrow end of a converging guide defined by walls 76*a* and 76*b*. Slidable cutter 70 includes a body 78 which is adapted and configured to slide within track 44. A fingergrip 74 extends outward from body 78.

Figure 18:
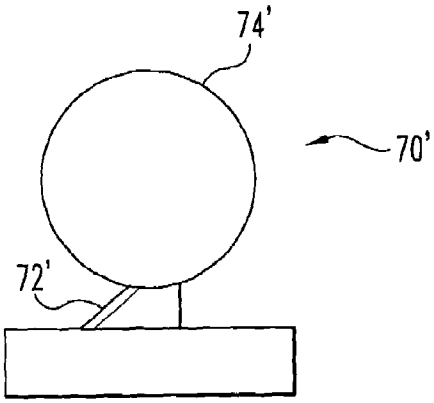
FIG. 18 is a view similar to FIG. 13 of a slidable cutter according to another embodiment of the present invention.

Cutter 70 is slidable within and retained within track 44 of cutting guide 42 along the length thereof. Track endstops 46 and 48 prevent cutter 70 from sliding free of track 44. The outwardly extending flanges of body 78 are preferably freely slidable within track 44. Finger grip 74 may be of any configuration suitable for gripping with the finger of the hand of the user. Referring to FIG. 13, cutting element 72 preferably includes a sharp edge which faces toward the diverging portion of converging guide 76. In one embodiment, cutting element 72 includes a sharp-edged metal surface, although the present invention contemplates any cutting edge fabricated from any type of material which is sufficiently sharp to cut the film contained within container 32. In one embodiment, cutting element 72 is oriented at about a right angle relative to the path of track 44. However, as best seen in FIG. 18, an alternate slidable cutter 70' includes a cutting element 72' which is oriented at an acute angle relative to track 44. By placing cutting element 72' at a non-perpendicular angle relative to track 44, movement of the cutter within the track places additional shearing action on the film to be cut.

Operation of apparatus 30 is as follows. A consumer opens container 32 and grabs free edge 36 of the supply 35 of film. The free edge is brought out of container 32, placed over the top surface of cutting guide 42, and temporarily adhered to adherent surface coating 54 in order to maintain the film in place. Slidable cutter 70 is then moved by the user along track 44 from endstop 46 toward endstop 48. As the sliding motion occurs, the portion of film extending across the open mouth of track 44 slides between converging surfaces 76*a* and 76*b* (FIG. 13) and is thereby fed toward cutting element 72. Cutting element 72 cuts the film as cutter 70 slides toward endstop 48. After the film has been cut, slider 70 is returned back to a home position near endstop 46 in preparation for the next cutting of the film.

Figure 6:
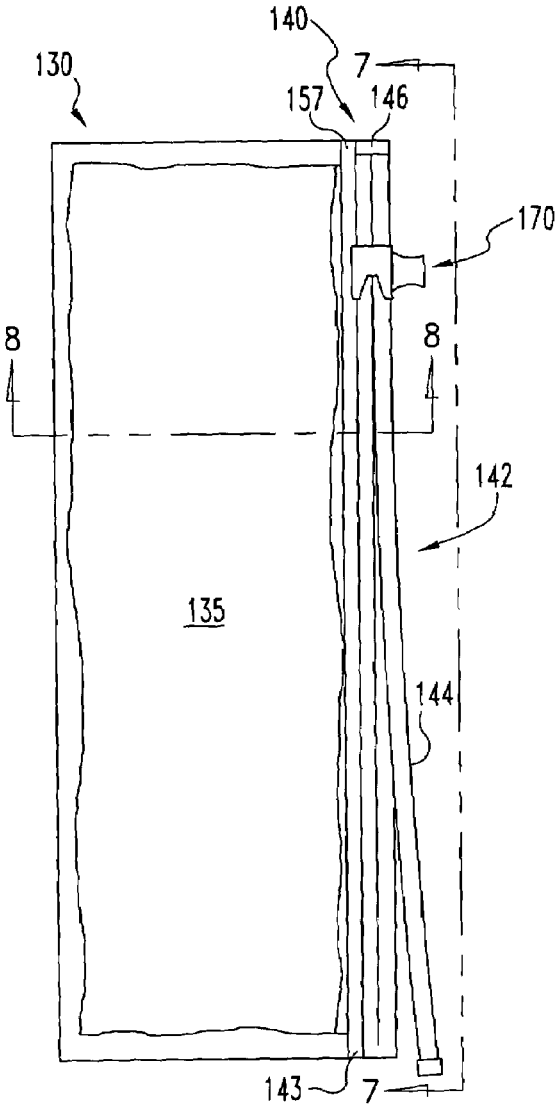
FIG. 6 is a side plan view of an apparatus according to another embodiment of the present invention.
Figure 7:
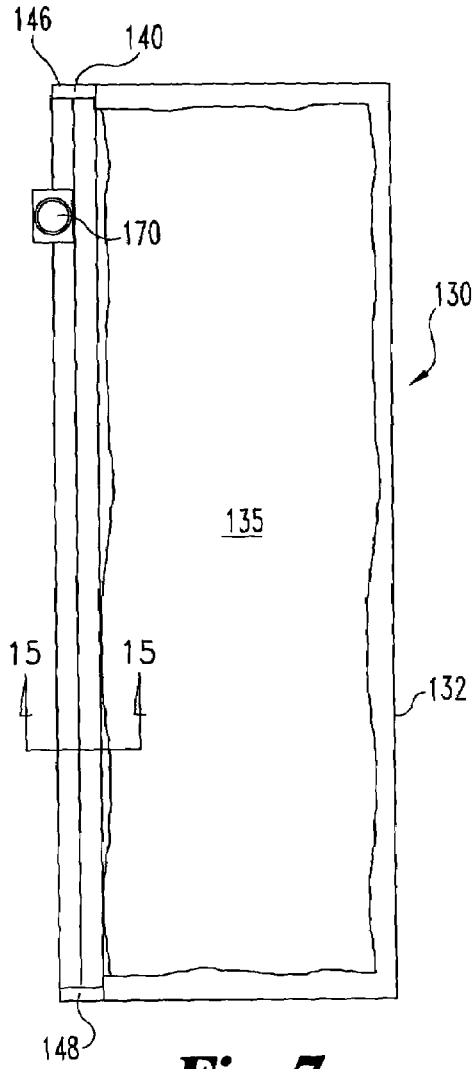
FIG. 7 is a top plan view of the apparatus of FIG. 6 as taken along lines 7—7 of FIG. 6 in the direction of the arrows.
Figure 8:
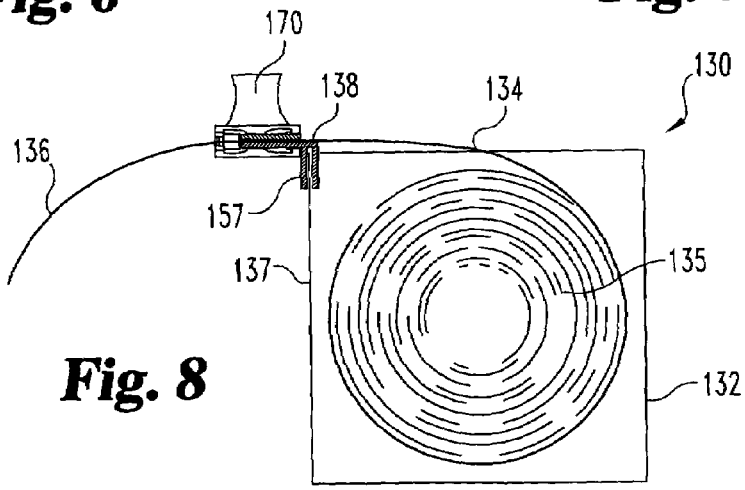
FIG. 8 is a cross sectional view of the apparatus of FIG. 6 as taken along lines 8—8 of FIG. 6.

Referring to FIGS. 6, 7, and 8, an apparatus 130 is shown according to another embodiment of the present invention. The use of a one hundred series prefix (1 XX) before an element number (XX) refers to a feature of the invention that is the same as the non-prefixed feature (XX) previously shown and described except for those differences shown and described hereafter. Apparatus 130 includes a container 132 having an opening 134. A supply 135 of flexible film is located within container 132. In one embodiment, container 132 is comprised of a plurality of semi-rigid cardboard walls 137, and the flexible film is a low density polyethylene film suitable for covering and storing food.

Figure 15:
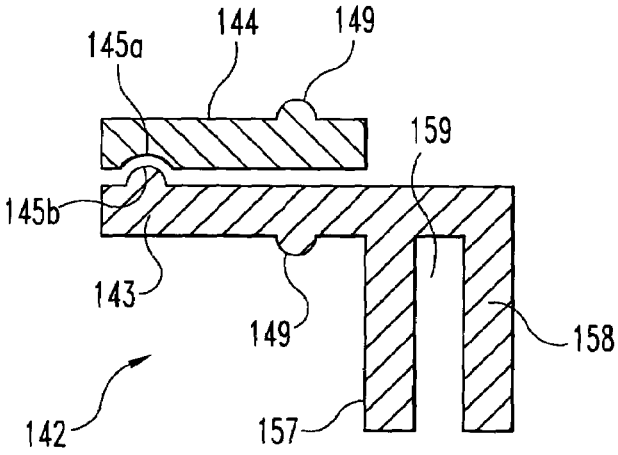
FIG. 15 is a cross sectional view of a portion of the apparatus of FIG. 7 as taken along line 15—15 of FIG. 7 in the direction of the arrows.

Container 132 includes an edge 138 along a wall 137. As best seen in FIGS. 6 and 8, a cutting assembly 140 is mounted along the length of edge 138. Cutting assembly 140 includes a cutting guide 142 (as best seen in FIG. 15). Cutting guide 142 includes a second lip 158 spaced apart from a first lip 157 so as to form a slot 159 therebetween. Slot 159 is adapted and configured to accept therein free edge 138 of container 132. In some embodiments, the consumer opens a new container 132, removes cutting assembly 140 from the interior of the container, and then places free edge 138 of wall 137 within slot 159. In some embodiments, wall 137 is retained within slot 159 by friction; whereas in other embodiments, adhesives, mechanical fasteners, or the like can be used to attach cutting assembly 140 along edge 138. Further, the present invention contemplates those embodiments in which the cutting assembly is integrally cast or molded onto a wall of the container.

Apparatus 130 includes a cutting assembly 140. Cutting assembly 140 includes a cutting guide 142 and a slidable cutter 170. As best seen in FIGS. 6 and 15, cutting guide 142 includes a first, lower gripping member 143 and a second, upper, preferably flexible gripping member 144. Cutting guide 142 preferably includes a second flexible gripping member 144 located above the lower first gripping member 143. Each gripping member 143 and 144 preferably includes one or more mating or alignment features on the inner, opposing faces of the gripping members. Referring to FIG. 15, lower gripping member 143 is shown with a projecting male mating feature 145*b*. Upper gripping member 144 is shown with a corresponding female mating feature 145*a*. These mating features are preferably complementary in shape, although the present invention contemplates those embodiments in which the mating features are not complementary, but in which the male feature fits within a portion of the female feature. Further, the present invention contemplates those embodiments in which the male mating feature can be on either the upper gripping or the lower gripping member. Further, the present invention contemplates those embodiments in which the gripping members include multiple male and female mating features. The present invention also contemplates those embodiments in which only one of the gripping members includes a male feature, and the opposing surface of the other gripping member does not having a corresponding female mating feature.

As best seen in FIGS. 6 and 7, the first and second gripping members 143 and 144 are joined together at a combined endstop 146 located at one end of the length of the gripping members. The members may be attached to each other in any manner, including fusion by ultrasonics and/or heat, riveting, or use of adhesive, as examples. In one embodiment, the opposing end of the length of lower gripping member 143 does not include an endstop, although the present invention contemplates those embodiments in which an endstop is included. Preferably, the opposing end of upper gripping member 144 includes a single endstop 148. Endstops 146 and 148 limit the sliding movement of slidable cutter 170 along their length. In one embodiment, gripping members 143 and 144 are not connected to each other except at combined endstop 146, and except by the squeezing action of slidable cutter 170. As shown in FIG. 6, in one embodiment upper gripping member 144 is flexible, and when cutter 170 is placed near endstop 146, member 144 can be flexibly separated from lower gripping member 146 and spaced apart from lower gripping member 143. However, the present invention also contemplates those embodiments in which upper gripping member 144 is rigid or semi-rigid and includes a hinging section (not shown) near endstop 146 which permits pivoting motion of gripping member 144 away from gripping member 143.

Referring to FIGS. 8 and 15, slidable cutter 170 is slidable along the length of gripping members 143 and 144. Each gripping member includes a shoulder 149 which protrudes outwardly from the respective gripping member. Slidable cutter 170 includes a pair of inwardly depending external feet 186 (refer to FIGS. 10 and 11) which co-act with shoulders 149 to make it difficult to pull cutter 170 off the gripping members.

Figure 11:
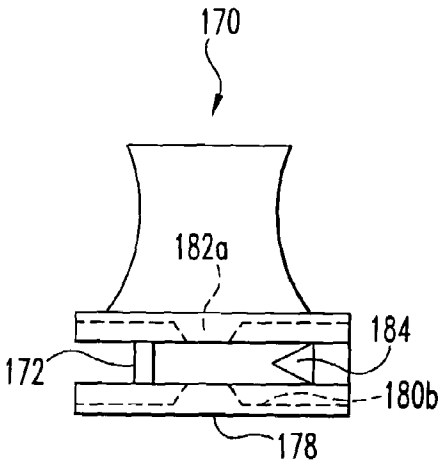
FIG. 11 is a side elevational view of the slidable cutter of FIG. 10 as taken along line 11—11 of FIG. 10 in the direction of the arrows.
Figure 10:
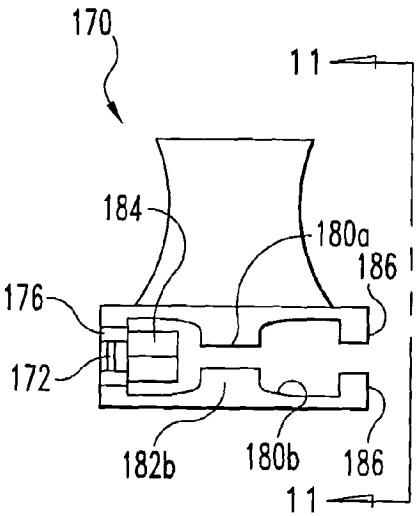
FIG. 10 is an end elevational view of the slidable cutter of FIG. 9 as taken along line 10—10 of FIG. 9 in the direction of the arrows.
Figure 9:
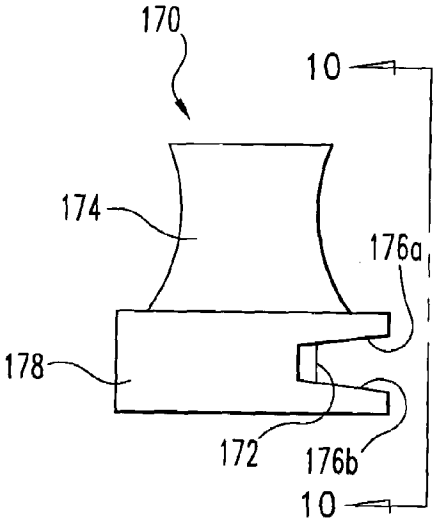
FIG. 9 is a side elevational view of the slidable cutter of FIG. 6.

FIGS. 9, 10, and 11 depict various views of slidable cutter 170. Cutter 170 includes a cutting element 172 located within the converging end of a slot defined by converging walls 176*a* and 176*b*. Cutter 170 includes a finger grip 174 attached to a body 178. Body 178 includes upper and lower walls 180*a* and 180*b* which slide over the outward faces of gripping members 143 and 144, respectively (as best seen in FIG. 8). Referring to FIGS. 10 and 11, a pair of internal ribs 182*a* and 182*b* depend inwardly from upper and lower walls 180*a* and 180*b*, respectively, and toward each other. In some embodiments of the present invention, cutting element 170 includes a separator 184 located within the interior of body 178. Separator 184 includes a narrow end useful for prying between interior facing surfaces of gripping members 143 and 144, and a wider end for separating apart gripping members 143 and 144.

Operation of apparatus 130 is as follows. A consumer opens container 132 and grabs free edge 136 of supply 135 of film. Upper gripping member 144 is moved away from lower gripping member 143, and the free end 136 from the supply 135 of film is placed on top of lower gripping member 143. Upper gripping member 144 is then released such that free edge 136 is loosely sandwiched between opposing faces of the gripping members. In order to cut the film, sliding cutter 170 is moved from combined endstops 146 toward single endstop 148. As the gripping members slide within the interior of cutting element 170, internal ribs 182*a* and 182*b* press the gripping members together. The film is held in place by friction from the mating faces of the gripping members. The co-action of male mating feature 145*b* within female mating feature 145*a* increases the frictional hold of the gripping members on the film. Gripping members 143 and 144 securely hold the film as cutting element 172 cuts the film. In some embodiments of the present invention, gripping members 143 and 144 include interlockable profile elements. In these embodiments, separator 184 of cutter 70 assists in releasing the interlock of the profile members.

Figure 16:
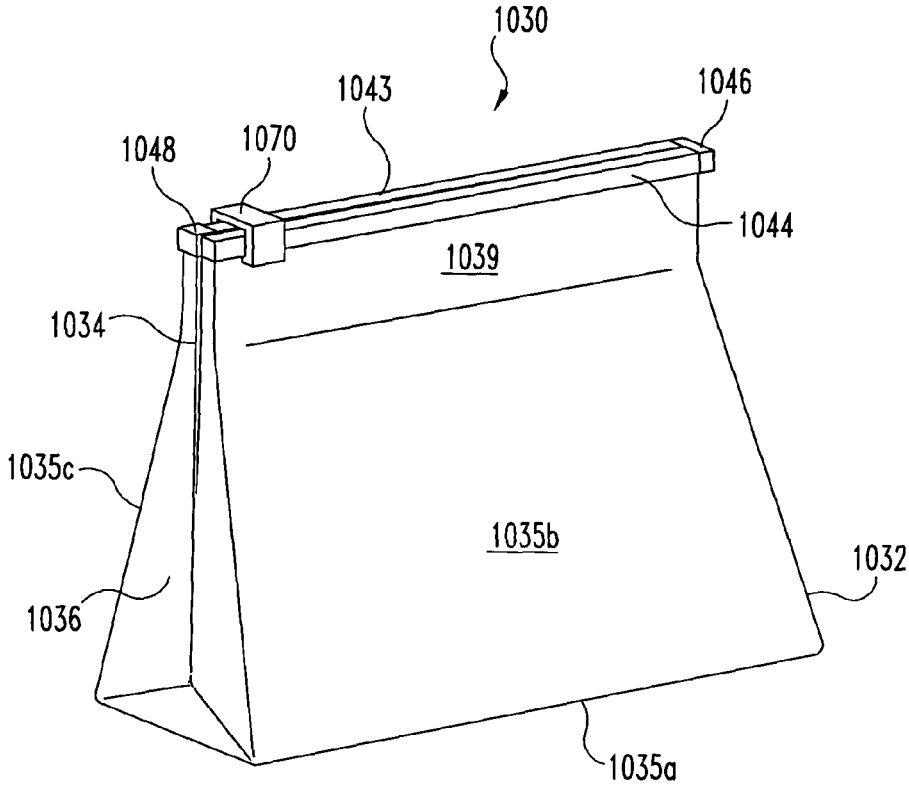
FIG. 16 is a front, side and top perspective view of a reclosable container according to another embodiment of the present invention.
Figure 17:
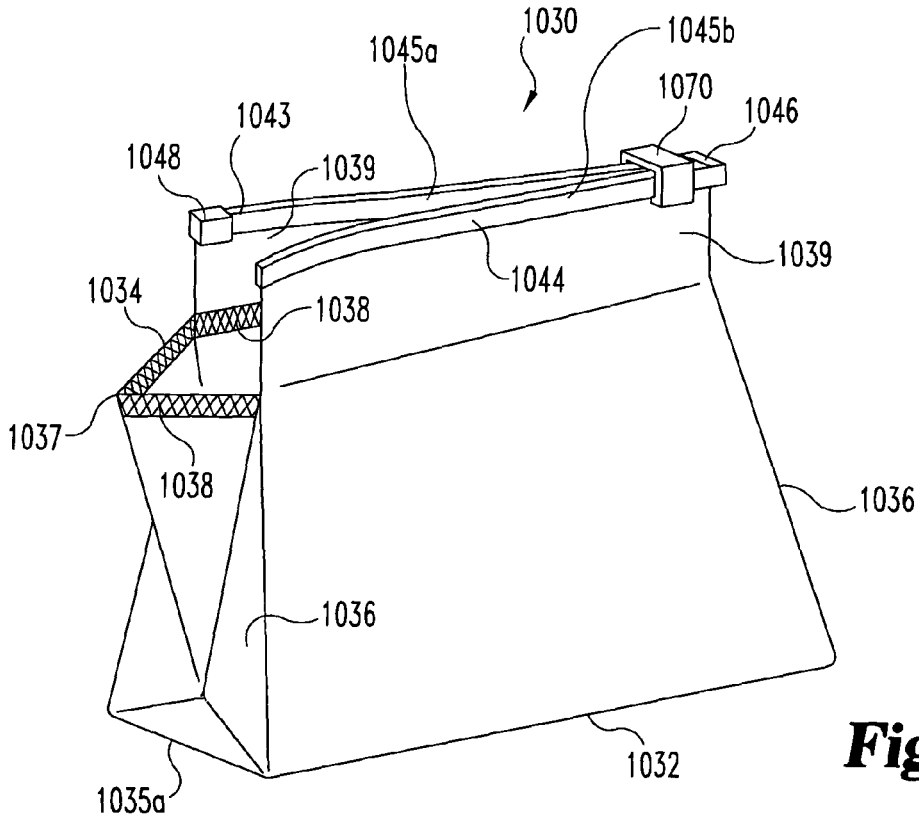
FIG. 17 shows the container of FIG. 16 in the opened state.

FIGS. 16 and 17 depict an apparatus 1030 according to another embodiment of the present invention. Apparatus 1030 includes a stand up pouch container 1032 preferably fabricated from flexible or semi-rigid material. Container 1032 can contain any type of contents, including for example, a drink, candy, potting soil, or other pourable material. Container 1032 includes a mouth 1034 which is generally opposite of a bottom 1035*a*. In some embodiments, container 1032 includes a bottom 1035*a* adapted and configured to permit container 1032 to stand. A pair of sidewalls 1035*b* and 1035*c* extend from mouth 1034 to the bottom 1035*a*. Preferably, container 1032 includes at least one side 1036 having an unbroken folding side gusset.

Preferably, container 1032 includes a pair of extended lips 1039 which extend from mouth 1034 upwardly toward a pair of interlockable fastener strips 1043 and 1044. Fastener strip 1043 includes a first interlockable profile 1045*a*, and second interlockable fastener strip 1044 includes a second interlockable profile 1045*b*. Interlockable profiles 1045*a* and 1045*b* may be of any type easily interlockable and separable. Fastener strips 1043 and 1044 are preferably joined together at combined endstop 1046 by any suitable means including fusion by ultrasonics and/or heat, adhesion and mechanical joining. In one embodiment, fastener strips 1043 and 1044 are not otherwise joined or coupled together, except at combined endstop 1046 and except as by action of a movable slider 1070. Slider 1070 is slidably coupled to fastener strips 1043 and 1044. Movement of slider 1070 in a first direction interlocks profiles 1045*a* and 1045*b*. Movement of slider 1070 in the opposite direction unlocks profiles 1045*a* and 1045*b* from each other. As shown in FIG. 17, in some embodiments of the present invention, only one of the fastener strips includes an endstop 1048 to prevent disengagement of slider 1070 from the fastener strips. However, the present invention also contemplates those embodiments in which each fastener strip includes a single endstop 1048.

In some embodiments, mouth 1034 of container 1032 includes one or more areas including a peelable seal, as shown in cross-hatch in FIG. 17. In some embodiments, peel seal 1038 extends in the inner surface of mouth 1034 along the length of container 1032. Further, in some embodiments, peel seal 1034 extends on both inner and outer surfaces of the top of side gusset 1036. In some embodiments, peel seal 1038 is a one-time peel seal which does not rejoin to itself after opening of container 1032 and initial separation of mouth 1034. However, in other embodiments, peel seal 1034 retains an ability to adhere to itself during subsequent reclosing of container 1032.

As shown in FIG. 16, movement of slider 1070 along fastener strips 1043 and 1044 toward the leftward end (as viewed in FIG. 16) results in interlocking of the fastener strips, and closure of mouth 1034. Folding side gusset 1036 is tucked in toward the interior of container 1032. Referring to FIG. 17, movement of slider 1070 toward the rightward and (as viewed in FIG. 17) results in the unlocking of fastener strips 1043 and 1044. Since the fastener strips are not attached to each other at the leftward end of container 1032, mouth 1034 can be spread apart and folding side gusset 1036 can be pulled outward to form a pouring spout 1037. Spout 1037 provides accurate, convenient means for the consumer to pour contents from the interior of container 1032.

Figure 19:
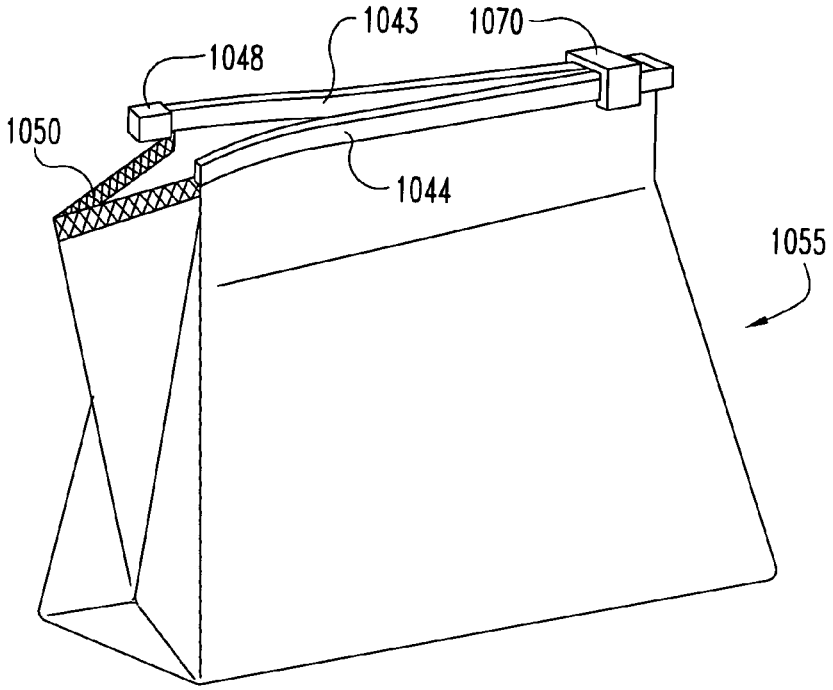
FIG. 19 is a perspective view similar to FIG. 16 of a further embodiment of the invention.

A preferred embodiment of the invention is shown in FIG. 19. The container 1055 of FIG. 19 is identical to the embodiment of FIGS. 16 and 17 except for the fact that the upper edge 1050 of the unbroken folding side gusset extends upwardly a greater extent than the folding side gusset 1036 of FIG. 17. Thus in some embodiments of the invention the material of which the container is made may be a single sheet of plastic in which the upper edge of the sheet is straight across including the upper edge 1050 of the gusset and the portion of the sheet attached to the interlockable profiles 1045*a* and 1045*b*.

Figure 23:
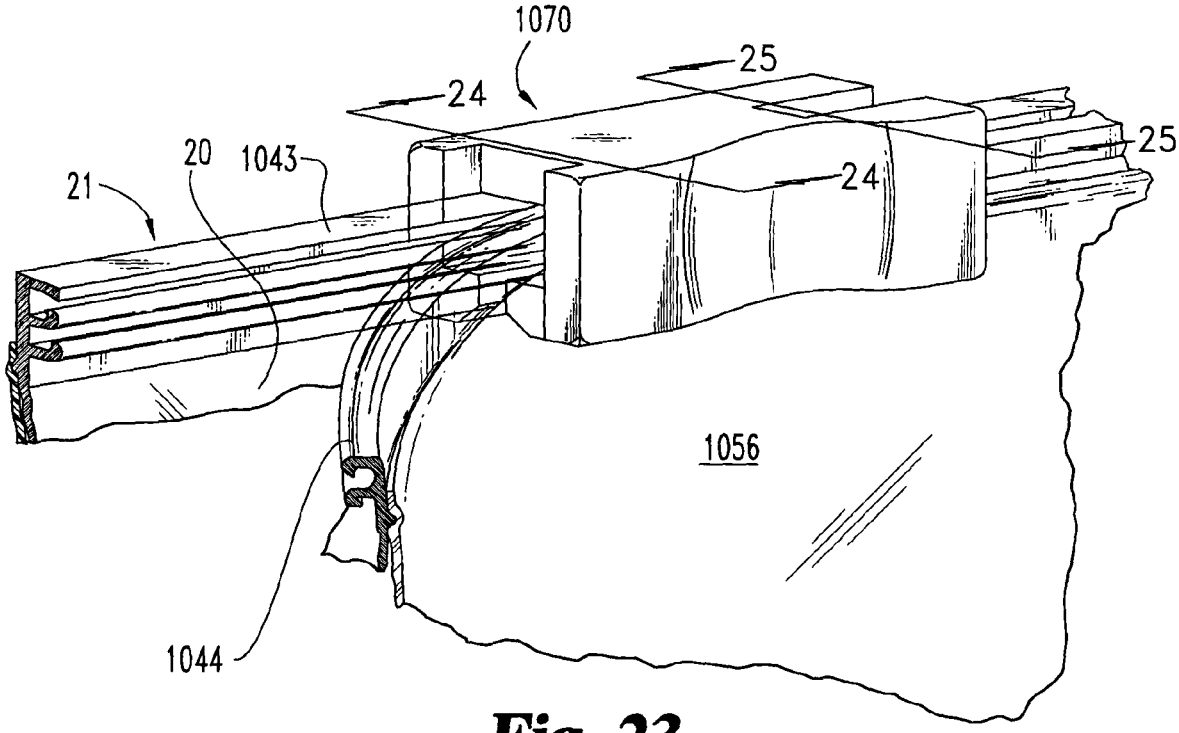
FIG. 23 is an enlarged fragmentary perspective view of a portion of the structure of FIG. 19.
Figure 24:
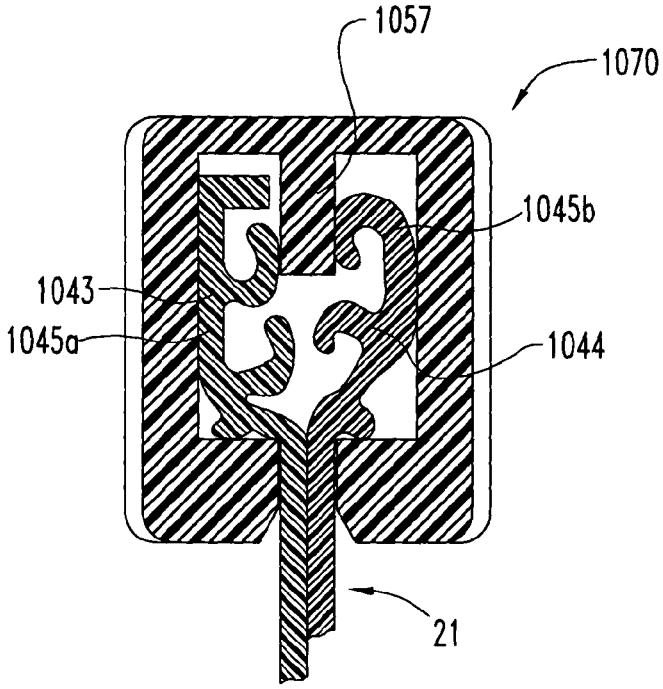
FIG. 24 is a vertical section taken along the line 24—24 of FIG. 23 in the direction of the arrows.
Figure 25:
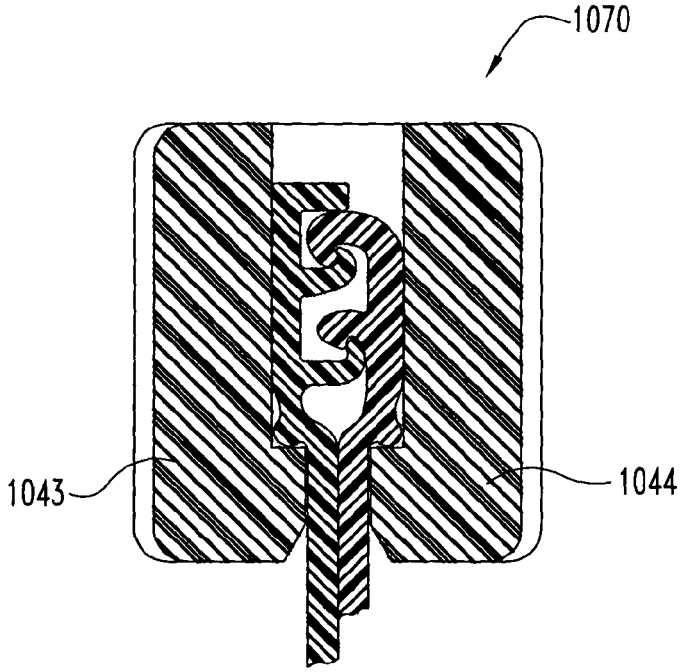
FIG. 25 is a vertical section taken along the line 25—25 of FIG. 23 in the direction of the arrows.

FIG. 23 shows one example of a slider 1070, interlockable profile 1045*a* and 1045*b* and plastic sheet 1056 that might be used in the container 1055. FIGS. 24 and 25 show sections taken in the direction of the arrows along the lines 24—24 and 25—25 in FIG. 23. The slider 1070 straddles the interlockable fastener strips 1043 and 1044. The slider has a fixed separator member 1057 which extends down between the profiles 1045*a* and 1045*b* for the purpose of separating them and opening the mouth of the container when the slider is moved to the right as viewed in FIGS. 17 and 23. When the slider is moved leftwardly as viewed in FIGS. 17 and 23, the slider functions to close the profile elements and to connect them as shown in FIG. 25.

Figure 20:
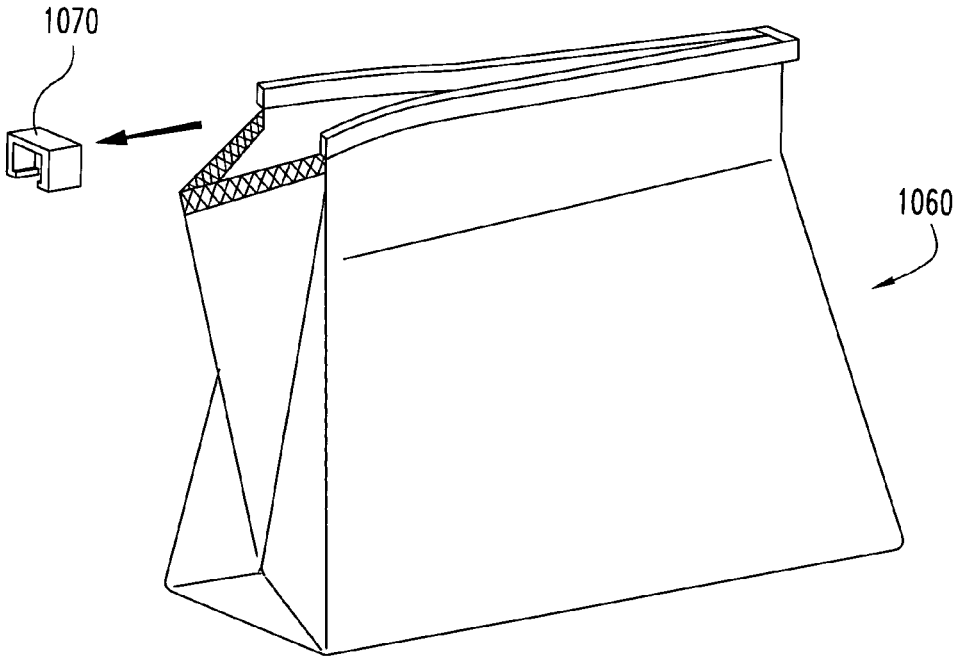
FIGS. 20, 21 and 22 are perspective views similar to FIG. 19 of still further embodiments of the invention.
Figure 21:
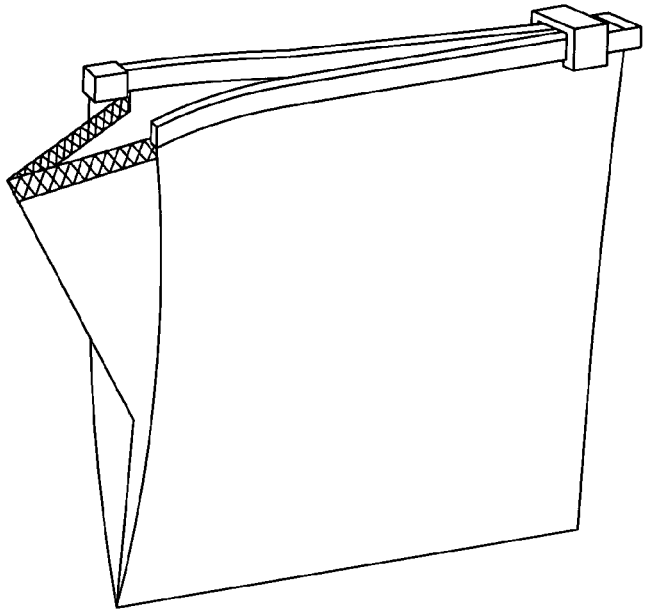
Figure 22:
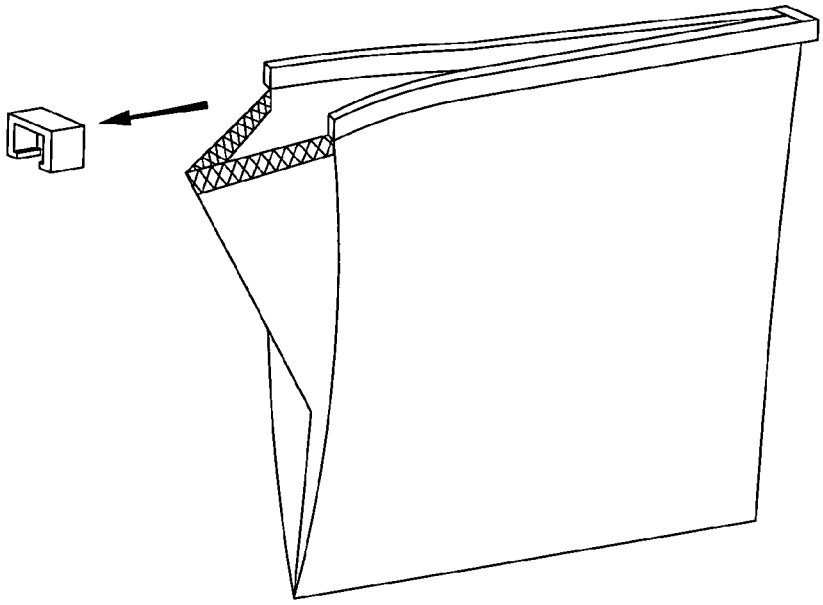

The apparatus has various alternative versions. As mentioned, one embodiment includes the end stop 1048 which prevents the slider from coming off the fastener strip 1043. In FIG. 20 there is illustrated a container 1060 which is identical to the container of FIG. 19 but has no end stop 1048. Thus the slider 1070 is removable from the fastener strips 1043 and 1044 as suggested by arrow 1060. In other respects the embodiment of FIG. 20 is identical to the embodiment of FIG. 19. Further examples of the invention are shown in FIGS. 21 and 22 which are identical to the embodiments of FIGS. 19 and 20 with the exception that they are not standup containers; however, they both have the same pour spout capability of the containers of FIGS. 19 and 20.

In one embodiment, the present invention includes an apparatus comprising a container of sheet material, the container including an opening for removing sheet material and a cutting assembly. The cutting assembly includes a track and a cutting element slidable within the track. The cutting element is adapted and configured for cutting of the sheet material.

Yet another embodiment of the present invention concerns an apparatus comprising a container, a cutter, and a cutting guide. The container includes a wall having an edge. The cutting guide is attached to the container proximate the edge. The cutting element co-acts with the cutting guide so that the cutting element and cutting guide are slidably captured together.

Yet another embodiment of the present invention concerns an apparatus comprising a flexible reclosable container having a pair of sidewalls, a bottom, and a mouth opposite the bottom. Located along opposing sides of the mouth are first and second interlockable fastener strips. The fastener strips are joined to each other at one end of the mouth. The strips are not joined to each other at the other end of the mouth. Some embodiments of the invention further include a slider for repeated locking and unlocking of the interlockable fastener strips.

Yet another embodiment of the present invention pertains to a flexible reclosable container arranged and configured to have a generally flat bottom on which the container can stand. One side of the container includes a folding gusset. The mouth of the container includes a pair of interlockable fastener strips which are joined together at one end, and not joined together at the other end. When the fastener strips are separated, the side gusset can be unfolded to an exterior position whereby the top of the gusset proximate to the mouth of the bag forms a spout for pouring contents from the interior of the container.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flexible, reclosable container comprising:

a pair of sidewalls forming a mouth having first and second sides, said mouth having first and second ends, each of said first and second sides of said mouth having a top edge;

a first interlockable profile attached proximate the top edge of a first side of said mouth, said first profile having a first end and a second end, the first end of said first profile being attached proximate the first end of said mouth;

a second interlockable profile attached proximate the top edge of a second side of said mouth, said second profile having a first end and a second end, the first end of said second profile being attached proximate the first end of said mouth, said first profile and said second profile being adapted and configured to releasably interlock with each other;

a slider slidingly coupled to said first profile and said second profile such that sliding said slider in a first direction toward the first end of said mouth interlocks said first profile to said second profile, and sliding said slider in a second direction toward the second end of said mouth unlocks said first profile from said second profile;

wherein the first end of said first profile is not attached to the first end of said second profile, and the second end of said first profile is attached to the second end of said second profile by an end stop for obstructing movement of said slider past the second end;

a gusset joining said first side of said mouth to said second side of said mouth at the first end, said gusset having a top, wherein said first interlockable profile is higher than the top of the gusset, and said second interlockable file is higher than the top of said gusset; and a peelable seal extending across at least a portion of the top of said gusset.

2. The container of claim 1 wherein said gusset can be unfolded to form an extendable spout at the first end of said mouth.

3. The container of claim 1 wherein at least one of the second end of said first profile or the second end of said second profile includes an end stop for obstructing the movement of said slider in the second direction.

4. The container of claim 1 wherein only one of the first end of said first profile or the first end of said second profile include an end stop for obstructing the movement of said slider in the first direction.

5. The container of claim 1 wherein said gusset is extendable as an outward spout.

6. The container of claim 1 wherein said gusset has a topmost edge which is lower than either of said profiles.

7. The container of claim 1 wherein the container has a bottom which is adapted and configured for supporting the bag in a standing position.

8. The container of claim 1 wherein the first interlockable profile is attached along substantially all of its length to the first side of said mouth, and the second interlockable profile is attached along substantially all of its length to the second side of said mouth.

* * * * *